United States Patent [19]

Sweeney

[11] 4,390,344

[45] Jun. 28, 1983

[54] GASOHOL MAINTAINED AS A SINGLE MIXTURE BY THE ADDITION OF AN ACETAL, A KETAL OR AN ORTHOESTER

[75] Inventor: William M. Sweeney, Wappingers Falls, N.Y.

[73] Assignee: Texaco Inc., White Plains, N.Y.

[21] Appl. No.: 134,023

[22] Filed: Mar. 26, 1980

[51] Int. Cl.[3] ..... C10L 1/18

[52] U.S. Cl. ..... 44/56; 252/407

[58] Field of Search ..... 44/56; 252/407

[56] References Cited

U.S. PATENT DOCUMENTS

| | | | |
|---|---|---|---|
| 2,114,676 | 4/1938 | Contardi et al. | 44/56 |
| 2,194,496 | 3/1940 | Christensen | 44/56 |
| 2,878,109 | 3/1959 | Wood et al. | 44/77 |
| 3,455,664 | 7/1969 | Rosscup et al. | 44/56 |
| 3,646,229 | 2/1972 | Archer et al. | 252/407 |
| 3,822,119 | 7/1974 | Frech et al. | 44/56 |

*Primary Examiner*—Charles F. Warren
*Assistant Examiner*—Y. Harris-Smith
*Attorney, Agent, or Firm*—Carl G. Ries; Robert A. Kulason; Carl G. Seutter

[57] ABSTRACT

Gasohol containing a mixture of gasoline and absolute ethanol, is maintained as a single phase mixture in the presence of water at pH below 7 by addition of an acetal; a ketal such as 2,2-dimethoxy propane; or an orthoester.

4 Claims, No Drawings

GASOHOL MAINTAINED AS A SINGLE MIXTURE BY THE ADDITION OF AN ACETAL, A KETAL OR AN ORTHOESTER

FIELD OF THE INVENTION

This invention relates to a novel method of stabilizing gasolines (including naphthas) containing a water-miscible alcohol, and to the so-stabilized compositions. More particularly it relates to the stabilization of a gasoline-ethanol or gasoline-methanol mixture containing water, to prevent phase separation.

BACKGROUND OF THE INVENTION

As is well known to those skilled in the art, liquid hydrocarbons may be combined with alcohols, typically water-miscible alcohols. Typical of such products is a mixture of motor fuel, such as gasoline or naphtha with an alcohol, such as ethanol. It is found that such mixtures, which are normally single-phase mixtures when formulated from e.g. gasoline and anhydrous ethanol, pick up water from various sources during handling; and the presence of this water in amounts as small as 0.1 v %–4 v % causes the composition to separate into two phases: (i) a hydrocarbon phase and (ii) an alcohol-water phase.

It is an object of this invention to provide a method of stabilizing such mixture to prevent formation of more than one phase. Other objects will be apparent to those skilled in the art.

STATEMENT OF THE INVENTION

In accordance with certain of its aspects, this invention is directed to a method of stabilizing a composition containing a gasoline and a water-miscible alcohol which is miscible with said gasoline whereby said composition is inhibited from separating into more than one layer on contact with water which comprises mixing (i) said composition containing gasoline and a water-miscible alcohol which is miscible with said gasoline, and (ii) as an additive a ketal or an acetal or an orthoester thereby forming a stabilized gasoline of increased water-tolerance; and recovering said stabilized gasoline of increased water-tolerance.

In accordance with certain of its other aspects, this invention is directed to a novel composition comprising a gasoline, a water-miscible alcohol which is miscible with said gasoline, and a ketal or an acetal or an orthoester.

DESCRIPTION OF THE INVENTION

The compositions which may be stabilized by the method of this invention include liquid hydrocarbon fuels. Although it is possible to stabilize liquid hydrocarbon fuels of lower molecular weight, the advantages of this invention are particularly apparent when the hydrocarbon fuel is a liquid at ambient conditions, typically 25° C. and atmospheric pressure.

The liquid hydrocarbon fuel may typically be a motor fuel such as a gasoline; a naphtha etc. when the fuel is a gasoline, it may for example be a 100 octane blended gasoline having an ep of 320° F. When the fuel is a naphtha it may be characterized by its ibp of 200° F. and its ep of 320° F.

Such liquid hydrocarbons are commonly mixed with 1 v %–20 v %, typically 5 v %–10 v %, say 10 v % of a water-miscible alcohol which is miscible with the hydrocarbon fuel. Mixing is typically effected, as in the case of gasoline, to extend the gasoline i.e. to permit attainment of a suitable gasoline while expending a lesser amount of hydrocarbon. A typical motor fuel so prepared may contain 90 v % gasoline and 10 v % absolute ethyl alcohol.

The water-miscible alcohols (which are also miscible with said hydrocarbon fuels) which may be used in practice of the process of this invention include methanol, ethanol, n-propyl alcohol, isopropyl alcohol, hexylene glycol-2,3; etc. Alcohols, such as iso-butanol, n-butanol, etc., which are only partially miscible with water and with hydrocarbon may be employed but their use is generally not advantageous.

Such mixtures, typically the composition containing 90 v % gasoline and 10 v % absolute ethanol form a single phase. However, as the composition acquires water from external sources in amounts typically greater than about 0.5 v %, it is noted that the composition separated into two phases: (i) a gasoline phase and (ii) an alcohol phase.

In practice of the process of this invention, this separation into two phases may be prevented by addition of a ketal or an acetal or an orthoester as an additive. Mixtures of more than one of these components may be employed.

The ketal may be characterized by the formula $R_2C(OR')_2$; the acetal may be characterized by the formula $RCH(OR')_2$; and the orthoester may be characterized by the formula $RC(OR')_3$.

In the above compound, R or R′ may be a hydrocarbon radical selected from the group consisting of alkyl and cycloalkyl, including such radicals when inertly substituted. When R is alkyl, it may typically be methyl, ethyl, n-propyl, iso-propyl, n-butyl, 1-butyl, sec-buty, amyl, octyl, decyl, octadecyl, etc. When R is cycloalkyl, it may typically be cyclohexyl, cycloheptyl, cyclooctyl, 2-methylcycloheptyl, 3-butylcyclohexyl, 3-methylcyclohexyl, etc. R may be inertly substituted i.e. it may bear a non-reactive substituent such as alkyl, cycloalkyl, ether, halogen, etc. Typically inertly substituted R groups may include 3-chloropropyl, 2-ethoxyethyl, carboethoxymethyl, 4-methyl cyclohexyl, etc. The preferred R groups may be lower alkyl, i.e. $C_1$–$C_{10}$ alkyl, groups including e.g. methyl, ethyl, n-propyl, i-propyl, butyls, amyls, hexyls, octyls, decyls, etc. R may preferably be methyl. R′ may preferably be methyl or ethyl.

In the preferred embodiment, R and R′ may be lower alkyl i.e. $C_1$ to $C_{10}$ but more preferably $C_1$ to $C_4$ alkyl. Illustrative ketals may include:

TABLE 2,2-dimethoxy propane
2,2-dimethoxy pentane
2,2-dimethoxy butane
3,3-dimethoxy pentane
2,2-diethoxy propane
2,2-di(cyclohexoxy) propane, etc.

Illustrative acetals may include:

TABLE di-methoxy methane
1,1-di-methoxy propane
1,1-diethoxy propane
1,1-dipropoxy propane
1,1-dimethoxy-n-butane 1,1-diethoxy-n-butane Illustrative orthoesters may include:

TABLE ethyl orthoformate
methyl orthobutyrate
n-propyl orthoacetate

In practice of this invention according to one embodiment of the process of this invention, the additive ketal or acetal or orthoester may be added to the alcohol composition when the composition is prepared or shortly thereafter. In this manner, the additive will prevent formation of two phases.

In another embodiment, the additive ketal or acetal or orthoester may be added after the composition has separated into more than one phase because of the presence of water. In this manner, the additive will permit formation of a single phase from the multiphase mixture.

It will be clear to those skilled in the art that the amount of additive employed will be a function of the amount of water which is reasonably expected to be present. It is observed that typically a mixture of gasoline (90 v %) and absolute ethanol (10 v %) will not form two phases until the amount of water added is about 0.5 v %; and accordingly the amount of additive may be determined to take into account percentage of water above that level. Commonly, satisfactory results are obtained if the molar amount of additive is at least equal to (preferably 5%–10% greater than) the molar amount of water to be reasonably expected. In practice, this indicates that the additive be present in amounts of 1 v %–25 v %, preferably 2 v %–10 v %, say ca 5 volumes percent of the composition. An illustrative composition may contain 90 volumes of gasoline, 10 volumes of absolute ethanol, and 5.7 volumes of 2,2-dimethoxy propane. Another illustrative composition may contain 64 volumes of gasoline, 17 volumes of absolute methanol, and 8 volumes of 2,2-dimethoxy propane.

It is a feature of the process of this invention that, in the presence of acid catalyst, the ketal or acetal or orthoester reacts with the water present to form alcohols.

The acid catalyst which may be employed in small-to-trace amounts may be an inorganic acid such as sulfuric acid, hydrochloric acid, etc. or an organic acid such as the strong acid p-toluene sulfonic acid etc. Typically such acids may be employed in amount of 0.0001 v %–1 v %, preferably 0.001 v %–0.1 v %, say 0.05 v % of the total composition. Concentrated sulfuric acid, in amount of 10 ppm, has been found to be satisfactory.

It is a particular feature of the process of this invention that it may be possible to use solid acid composition bearing protons to catalyse the reaction of water with ketal or acetal or orthoester. Typical of such solid acids are resins such as reticular sulfonated styrene-divinyl benzene copolymerization exchange resins typified by the Rohm and Haas Amberlyst 15 having a hydrogen ion concentration of 4.9 meq per gram of dry resin and a surface area of 42.5 square meters per gram.

The acid catalyst is commonly employed in catalytic amount sufficient to produce in the aqueous phase a pH low enough to catalyze the reaction of acetal or ketal or orthoester with water. Typically a pH below 7 and commonly 1–6.5. Preferred range may be above about 5 and below 7 in the aqueous phase.

It may be noted that it is preferred, although not necessary to have acid present. If one is formulating a single phase composition such a dry gasoline and absolute alcohol, it may be possible to maintain this in single phase by addition of the requisite amount of ketal or acetal or orthoester. The acid which catalyzes the reaction of the ketal or acetal or orthoester with water may be present in the various containers or conduits through which the composition passes. However if the composition already contains substantial water or if it has already exceeded the solubility limit and has separated into two phases then it is preferred to accelerate the reaction by addition of acid.

In carrying out the process of this invention to stabilize a composition containing a liquid hydrocarbon and a water miscible alcohol which is miscible with the hydrocarbon, it may be desirable to add ketal or acetal or orthoester and the acid, preferably a liquid acid, directly to the composition and to agitate the mixture. This will provide a single phase mixture and when the additive is present in amount greater than that necessary to react with the water present, it will also provide protection against the formation of two phases when the mixture is later brought into contact with water.

If the composition has been contacted with, or otherwise contains enough water to permit formation of more than one phase, it may be desirable to add the ketal or acetal or orthoester and the acid and to agitate the mixture. In this instance, it may be desirable for example to suspend, in the agitated mixture of composition plus acetal or ketal or orthoester, porous bags or baskets of solid acid such as resin pellets in acid form.

The stabilized compositions may be found to be stable over an extended period of time and, when mixed with adequate proportions of ketal or acetal or orthoester, may be stable in the presence of unexpectedly large quantities of water.

It appears that the ketal or acetal or orthoester may function by reacting with the water in the presence of catalytic amounts of acid thereby forming alcohols. Thus the additives remove the water and also form alcohols which are miscible with the composition. When the additive contains methyl or ethyl groups, the resultant alcohols formed are methanol and ethanol.

Practice of the process of this invention may be apparent to those skilled in the art from the Examples which follow.

DESCRIPTION OF PREFERRED EMBODIMENTS

EXAMPLE I

In this embodiment of the invention, 100 volumes of gasahol (containing 90 volumes of gasoline and 10 volumes of absolute ethanol) are mixed with 1.8 volumes of water. This caused separation into a gasoline-rich phase and an ethanol rich phase. To this compound, 2,2-dimethoxy propane (13.46 volumes) and a small drop (ca 0.5 volumes) of concentrated sulfuric acid is added. After agitation for a short period, the two phases disappear; and the composition exhibits a single phase.

EXAMPLE II

In this Example, a mixture is formed containing 100 parts of gasahol (containing 90 volumes of gasoline and 10 volumes of absolute ethanol), 13.46 volumes of 2,2-dimethoxy propane, and a drop of concentrated sulfuric acid. The mixture exhibited one phase. After addition thereto of 1.8 volumes of water, the mixture still exhibits one phase.

EXAMPLE III

In this Example, the procedure of Example I is followed except that, in place of the drop of sulfuric acid, there is added 2 volumes of dry Amberlyst 15, a solid ion-exchange resin containing styrene-divinyl benzene copolymer in the acid form. The mixture maintains a single phase.

EXAMPLE IV

In this Example, there are mixed 100 volumes of dry gasoline, 10 volumes of absolute ethanol, and 13.46 volumes of 2,2-dimethoxy propane. The mixture is a single phase mixture. There is added thereto 1.8 volumes of tap water of pH 5. after agitation for a short period, the mixture is a single phase mixture.

EXAMPLE V

In this Example, there are mixed 100 volumes of dry gasoline, 10 volumes of absolute ethanol, and 13.47 volumes of 2,2-dimethoxy propane. The mixture is a single phase mixture. There is added thereto 1.8 volumes of distilled water of pH 7.2. After agitation for a short period, the mixture is a two-phase mixture. Agitation in the presence of a porous container of Amberlyst 15 copolymer is found to lower the pH to about 6.5 and to result in formation of a single phase.

EXAMPLES VI–XII

Results comparable to the above may be obtained if the additive, instead of being 2,2-dimethoxy propane, is as follows:

| EXAMPLE | ADDITIVE |
|---|---|
| VI | ethyl orthoformate |
| VII | 2,2-diethoxy propane |
| VIII | 1,1-dimethoxy ethane |
| IX | 1,1-dimethoxy-n-butane |
| X | 1,1-diethoxy-n-butane |
| XI | 2,2-dimethoxy-n-butane |
| XII | 2,2-diethoxy-n-butane |

Results comparable to the above may be obtained if the hydrocarbon composition is as follows:

| EXAMPLE | HYDROCARBON |
|---|---|
| XIII | Aviation Gasoline (100 octane) |
| XIV | Aviation Gasoline (80 octane) |
| XV | Lead Free Gasoline (91 octane) |
| XVI | Heavy Naphtha |

Although this invention has been illustrated by reference to specific embodiments, it will be apparent to those skilled in the art that various changes and modifications may be made which clearly gall within the scope of this invention.

I claim:

1. The method of stabilizing a composition containing a gasoline and a water-miscible alcohol which is miscible with said gasoline whereby said composition is inhibited from separating into more than one layer on contact with water which comprises mixing (i) said composition containing a gasoline and a water-miscible alcohol which is miscible with said gasoline, (ii) as an additive, an orthoester thereby forming a stabilized composition of increased water-tolerance which remains a single phase mixture at pH below 7 in the presence of water; and recovering said stabilized composition of increased water-tolerance.

2. The method of stabilizing a composition containing a gasoline and a water-miscible alcohol which is miscible with said gasoline whereby said composition is inhibited from separating into more than one layer on contact with water which comprises mixing (i) said composition containing a gasoline and a water-miscible alcohol which is miscible with said gasoline, (ii) as an additive, orthoformate thereby forming a stabilized composition of increased water-tolerance which remains a single phase mixture at pH below 7 in the presence of water; and recovering said stabilized composition of increased water-tolerance.

3. A novel composition inhibited from separating into more than one layer on contact with water at pH below 7 which comprises a gasoline, a water-miscible alcohol which is miscible with said gasoline, and an orthoester.

4. A novel composition inhibited from separating into more than one layer on contact with water at pH below 7 which comprises a gasoline, a water-miscible alcohol which is miscible with said gasoline, and ethyl orthoformate.

* * * * *